US008302809B1

(12) United States Patent
Bogdziewicz, III et al.

(10) Patent No.: US 8,302,809 B1
(45) Date of Patent: Nov. 6, 2012

(54) PRODUCT DISPENSING SYSTEM WITH INCREASED PRODUCT-TO-DISPENSER CONTACT

(75) Inventors: William J. Bogdziewicz, III, Richmond, VA (US); John Gelardi, Midlothian, VA (US); Aaron L. Bates, Moseley, VA (US); Laurel Thomas, Richmond, VA (US)

(73) Assignee: MeadWestvaco Corporation, Richmond, VA (US)

( * ) Notice: Subject to any disclaimer, the term of this patent is extended or adjusted under 35 U.S.C. 154(b) by 56 days.

(21) Appl. No.: 13/105,395

(22) Filed: May 11, 2011

(51) Int. Cl.
*B65G 65/23* (2006.01)

(52) U.S. Cl. ..... 221/31; 414/412; 83/165; 83/856; 83/946; 229/122.2; 229/204

(58) Field of Classification Search ..... 53/381.2; 221/31; 83/946, 856, 164, 165; 414/412; 229/204, 122.2; 206/239; 222/81
See application file for complete search history.

(56) References Cited

U.S. PATENT DOCUMENTS

| | | | | |
|---|---|---|---|---|
| 902,347 | A | 10/1908 | Tillinghast | |
| 1,291,420 | A | 1/1919 | Cough | |
| 1,383,318 | A | 7/1921 | McCormick | |
| 1,393,964 | A | 10/1921 | Potts et al. | |
| 1,753,957 | A | 4/1930 | Washburn | |
| 1,824,937 | A | 9/1931 | Trouth | |
| 1,858,199 | A * | 5/1932 | De Maziroff | 206/239 |
| 1,898,056 | A | 2/1933 | Johnson | |
| 1,919,907 | A | 7/1933 | Robinson | |
| 1,932,225 | A | 10/1933 | Minter | |
| 1,941,458 | A | 2/1934 | Bens | |
| 1,985,739 | A | 12/1934 | Murray | |
| 2,078,599 | A | 4/1937 | McCauley | |
| 2,110,194 | A | 3/1938 | Blier | |
| 2,263,353 | A | 11/1941 | Eidam | |
| 2,291,187 | A | 7/1942 | Johnson | |
| 2,382,191 | A | 7/1944 | Weichselbaum | |
| 2,536,421 | A | 2/1951 | Burhans | |
| 2,573,381 | A | 10/1951 | Arnold | |
| 2,574,087 | A | 11/1951 | Burhans | |

(Continued)

FOREIGN PATENT DOCUMENTS

| | | |
|---|---|---|
| DE | 2655496 | 6/1978 |

(Continued)

OTHER PUBLICATIONS

International Search Report and Written Opinion issued in PCT/US2010/057020 (Mar. 8, 2011).

(Continued)

*Primary Examiner* — Kenneth E. Peterson
(74) *Attorney, Agent, or Firm* — Walters & Wasylyna, LLC

(57) ABSTRACT

A product dispensing system including a container defining an internal volume and an opening into the internal volume, the container including a weakening feature, the opening and the weakening feature defining an access panel, and a dispenser including a frame having longitudinally opposed first and second ends, and including a support deck and a product display area, the support deck extending at least partially between the first and second ends, the product display area being positioned below the support deck, and a catch element connected to the frame proximate the first end, the catch element protruding away from the second end such that the catch element engages the opening in the container and at least partially separates the access panel from the container as the container longitudinally moves along the support deck from the first end toward the second end.

14 Claims, 10 Drawing Sheets

U.S. PATENT DOCUMENTS 2,595,122 A 4/1952 Burhans
2,784,871 A 3/1957 Gabrielsen
2,795,845 A 6/1957 Shimer
2,818,978 A 1/1958 Post
2,826,471 A 3/1958 Fonda
2,831,591 A 4/1958 Morton
2,888,145 A 5/1959 Knott et al.
2,915,932 A 12/1959 Gross
2,919,488 A 1/1960 Brownlee
2,996,344 A 8/1961 Garman
3,018,149 A 1/1962 Parker
3,055,293 A 9/1962 Lariccia
3,066,827 A 12/1962 Pryor
3,137,068 A 6/1964 Quigley
D198,888 S 8/1964 Heselov
3,178,242 A 4/1965 Ellis et al.
3,184,104 A 5/1965 De Domenico et al.
3,203,554 A 8/1965 Pendergrast et al.
3,204,335 A 9/1965 Hughes
3,288,544 A 11/1966 Knecht
3,300,115 A 1/1967 Schauer
3,304,141 A 2/1967 Rogers
3,318,455 A 5/1967 Takahashi
3,335,940 A 8/1967 Dykes
3,340,790 A 9/1967 Simjian
3,348,738 A 10/1967 Hertlein
3,392,901 A 7/1968 Krzyzanowski
3,393,808 A 7/1968 Chirchill
3,501,016 A 3/1970 Eaton
3,763,557 A 10/1973 Sewell
3,784,022 A 1/1974 Beesley, Jr.
3,922,778 A 12/1975 Aalpoel
3,923,159 A 12/1975 Taylor et al.
3,972,454 A 8/1976 Croley
4,105,126 A 8/1978 Deffner et al.
4,205,440 A 6/1980 Morgan
4,260,072 A 4/1981 Quasarano
4,318,458 A 3/1982 Ritsema
4,382,526 A 5/1983 Stone
4,396,143 A 8/1983 Killy
4,435,026 A 3/1984 Johnson
4,467,524 A 8/1984 Ruff et al.
4,576,272 A 3/1986 Morgan, Jr.
4,598,828 A 7/1986 Young et al.
4,729,480 A 3/1988 Groover et al.
4,744,489 A 5/1988 Binder et al.
4,834,263 A 5/1989 Becze
4,869,395 A 9/1989 Rubbmark
4,911,309 A 3/1990 Stefan
4,915,571 A 4/1990 Toshihiko et al.
4,923,070 A 5/1990 Jackle et al.
4,997,106 A 3/1991 Rockola
4,998,628 A 3/1991 Ross
5,033,348 A 7/1991 Walsh
5,080,256 A 1/1992 Rockola
5,101,703 A 4/1992 Tanaka et al.
5,167,345 A 12/1992 Bleeker
5,190,155 A 3/1993 Grunwald
5,251,972 A 10/1993 Zurawin
5,289,943 A 3/1994 Powell
5,314,078 A 5/1994 Morikiyo et al.
5,328,258 A 7/1994 Scalise
5,356,033 A 10/1994 Delaney
5,372,278 A 12/1994 Leight
5,390,821 A 2/1995 Markel
5,396,997 A 3/1995 Johnson
D363,174 S 10/1995 Fletcher, Sr.
5,462,198 A 10/1995 Schwimmer
5,529,207 A 6/1996 Oden et al.
5,638,988 A 6/1997 Rogers
5,685,664 A 11/1997 Parham et al.
5,740,610 A 4/1998 Ayer et al.
5,788,117 A 8/1998 Zimmanck
5,791,048 A 8/1998 Bodnar et al.
5,836,478 A 11/1998 Weiss
5,878,862 A 3/1999 Dewsnap
5,894,942 A 4/1999 Miyashita et al.
5,924,573 A 7/1999 Piraneo et al.
5,992,286 A 11/1999 Boole
5,992,652 A 11/1999 Springs
6,186,345 B1 2/2001 Robertson
6,199,720 B1 3/2001 Rudick et al.
6,206,237 B1 3/2001 Dillon et al.
6,253,930 B1 7/2001 Freidus et al.
6,267,258 B1 7/2001 Wilkerson et al.
6,393,799 B2 5/2002 Jenkins et al.
6,637,604 B1 10/2003 Jay
6,802,433 B2 10/2004 Leykin
6,991,116 B2 1/2006 Johnson et al.
7,207,447 B2 4/2007 Medcalf et al.
7,303,095 B2 12/2007 Nagelski et al.
7,546,973 B2 6/2009 Budz et al.
7,584,854 B2 9/2009 Chandaria
D604,972 S 12/2009 Henry et al.
7,665,618 B2 2/2010 Jay et al.
7,681,745 B2 3/2010 Richter
7,810,672 B1 10/2010 Mason et al.
7,823,733 B2 11/2010 Futori
7,850,015 B1 12/2010 Mason
7,913,860 B2 3/2011 Merl
7,918,365 B2 4/2011 White et al.
7,922,437 B1 4/2011 Loftin et al.
8,028,855 B2 10/2011 White et al.
2002/0043509 A1 4/2002 Lajeunesse et al.
2004/0011751 A1 1/2004 Johnson et al.
2004/0079760 A1 4/2004 Rink
2004/0262326 A1 12/2004 Christensen
2005/0092644 A1 5/2005 Cafferata
2005/0127015 A1 6/2005 Medcalf et al.
2005/0207877 A1 9/2005 Haverdink
2006/0081692 A1 4/2006 Stewart et al.
2006/0237384 A1 10/2006 Neumann et al.
2006/0278591 A1 12/2006 Tippets et al.
2007/0194037 A1 8/2007 Close
2008/0245813 A1 10/2008 Johnson et al.
2009/0212066 A1 8/2009 Bauer
2009/0266776 A1 10/2009 Johnson
2009/0277853 A1 11/2009 Bauer
2010/0032391 A1 2/2010 Schneider et al.
2011/0121010 A1 5/2011 Loftin et al.
2011/0121011 A1 5/2011 Gelardi et al.

FOREIGN PATENT DOCUMENTS

DE 29808673 11/1998
DE 19808162 9/1999
DE 20111307 10/2001
DE 202007012114 11/2007
GB 2190906 12/1987
GB 2303624 2/1997
JP 03105494 A 5/1991
JP 03133737 A 6/1991
JP 03198192 A 8/1991
JP 03273469 A 12/1991
JP 03273470 A 12/1991
JP 03273471 A 12/1991
JP 03273472 A 12/1991
JP 03273474 A 12/1991
JP 03273476 A 12/1991
JP 03273477 A 12/1991
JP 03273480 A 12/1991
JP 03273482 A 12/1991
JP 03273483 A 12/1991
JP 04086985 A 3/1992
JP 04115392 A 4/1992
JP 04137194 A 5/1992
JP 05004640 A 1/1993
JP 05174239 A 7/1993
JP 05346984 A 12/1993
JP 08161611 A 6/1996
JP 09027066 A 1/1997
JP 09102065 A 4/1997
JP 09282537 A 10/1997
JP 09311971 A 12/1997
JP 10269421 A 10/1998
JP 11011471 A 1/1999
JP 11171264 A 6/1999
JP 11191175 A 7/1999

| | | | |
|---|---|---|---|
| JP | 11328513 | A | 11/1999 |
| JP | 2001072076 | A | 3/2001 |
| JP | 2001206358 | A | 7/2001 |
| JP | 2003327243 | A | 11/2003 |
| JP | 2004017970 | A | 1/2004 |
| JP | 2005338910 | A | 12/2005 |
| JP | 04157593 | B1 | 10/2008 |
| WO | WO-9106076 | A1 | 5/1991 |
| WO | WO 9321074 | | 10/1993 |
| WO | WO 9423619 | | 10/1994 |
| WO | WO 0054632 | | 9/2000 |
| WO | WO 2004014755 | | 2/2004 |
| WO | WO 2004113808 | | 12/2004 |
| WO | WO 2009138538 | | 11/2009 |
| WO | WO 2011025483 | | 3/2011 |
| WO | WO 2011109350 | | 9/2011 |

OTHER PUBLICATIONS

International Search Report and Written Opinion issued in PCT/US2010/057221 (Mar. 4, 2011).

International Search Report and Written Opinion issued in PCT/US2012/031383.

* cited by examiner

PRODUCT DISPENSING SYSTEM WITH INCREASED PRODUCT-TO-DISPENSER CONTACT

FIELD

This application relates to the dispensing of products from packaging containers and, more particularly, to product dispensers configured to cooperate with packaging containers to dispense products.

BACKGROUND

Products are typically shipped to retailers in bulk by enclosing multiple individual product units in a container, such as a carton or box. For example, canned foods may be shipped to a retailer in a box containing twenty-four individual cans. Then, it is typically the retailer's obligation to remove the individual product units from the container and present them (e.g., on a shelf) to consumers.

Alternatives to the traditional package-ship-unpack-display model are being developed in an effort to improve operating efficiency. For example, U.S. Pat. No. 7,922,437 to Lofton et al. discloses a new system for dispensing and displaying products packaged in a container. Specifically, the system includes a frame having a support structure, a product display area and an opening tool. The frame may be positioned on a retailer's shelf and loaded with product simply by placing a container comprising multiple units of product onto the support structure of the frame. As the container is being placed onto the support structure, the opening tool of the frame opens the container in such a manner that products roll from the container and down to the product display area of the frame under the force of gravity. The entire contents of U.S. Pat. No. 7,922,437, which issued on Apr. 12, 2011, are incorporated herein by reference.

As another example, U.S. patent application Ser. No. 13/032,734 filed by Gelardi et al. discloses a product dispensing system that utilizes an opening tool having a catch element that engages and opens a container as the container is loaded onto the dispenser, and then guides the container to avoid interference between the dispensing products and the open container. The entire contents of U.S. patent application Ser. No. 13/032,734, which was filed on Feb. 23, 2011, are incorporated herein by reference Despite advances already made in the field, those skilled in the art continue with research and development efforts directed to apparatus and systems for dispensing products from packaging containers.

SUMMARY

In one aspect, the disclosed product dispensing system may include a container defining an internal volume and an opening into the internal volume, the container including a weakening feature, the opening and the weakening feature defining an access panel, and a dispenser including a frame having longitudinally opposed first and second ends, and including a support deck and a product display area, the support deck extending at least partially between the first and second ends, the product display area being positioned below the support deck, and a catch element connected to the frame proximate the first end, the catch element protruding away from the second end such that the catch element engages the opening in the container and at least partially separates the access panel from the container as the container longitudinally moves along the support deck from the first end toward the second end.

In another aspect, the disclosed product dispensing system may include a container defining an internal volume and an opening into the internal volume, the container including first and second weakening features, wherein the opening and the first and second weakening features define an access panel, a plurality of products positioned in the internal volume, and a dispenser including a frame having longitudinally opposed front and rear ends, the frame including a support deck and a product display area, the support deck extending at least partially between the front and rear ends and defining an opening therein, the product display area being positioned below the support deck proximate the front end, and a catch element protruding from the support deck away from the rear end such that the catch element engages the opening in the container, at least partially separates the access panel from the container, and directs the separated access panel through the opening in the support deck as the container longitudinally moves along the support deck from the front end toward the rear end, thereby allowing at least one of the products to move along the support deck to the product display area.

In yet another aspect, the disclosed method for dispensing products may include the steps of (1) providing a dispenser including a frame having longitudinally opposed first and second ends, the frame including a support deck and a product display area, the support deck extending at least partially between the first and second ends, the product display area being positioned below the support deck, and a catch element connected to the frame proximate the first end, the catch element protruding away from the second end, (2) providing a container housing a plurality of products, the container defining an opening and an access panel, and (3) urging the container longitudinally along the support deck from the first end toward the second end of the frame such that the catch element engages the opening in the container and at least partially separates the access panel from the container, thereby allowing at least one of the products to move along the support deck and down to the product display area.

Other aspects of the disclosed product dispensing system with increased product-to-dispenser contact will become apparent from the following detailed description, the accompanying drawings and the appended claims.

DETAILED DESCRIPTION

Figure 1:
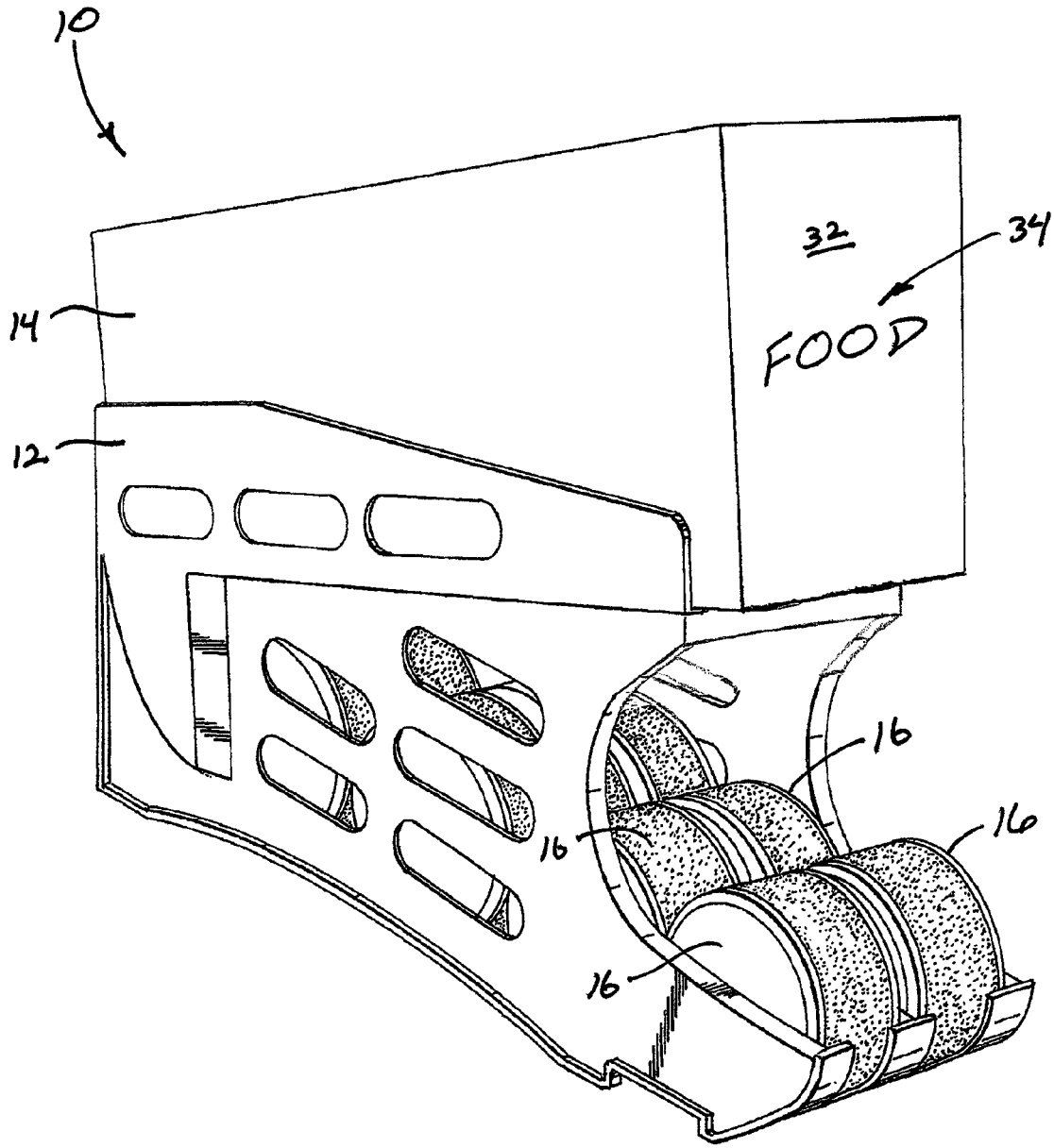
FIG. 1 is a front and side perspective view of one aspect of the disclosed product dispensing system with increased product-to-dispenser contact.

Referring to FIG. 1, one aspect of the disclosed product dispensing system with increased product-to-dispenser contact, generally designated 10, may include a dispenser 12 and a container 14. The container 14 may house multiple units of product 16. Therefore, as the container 14 is loaded onto the dispenser 12 by urging the container 14 generally horizontally along the dispenser 12, the dispenser 12 may engage and open the container 14, thereby releasing the products 16 from the container 14 to the dispenser 12 without the container 14 interfering with movement of the products 16 from the container 14 and through the dispenser 12.

The container 14 may be any container capable of housing products 16 and beneficially interacting with the disclosed dispenser 12. For example, the container 14 may be a paperboard carton or a corrugated box.

Figure 2:
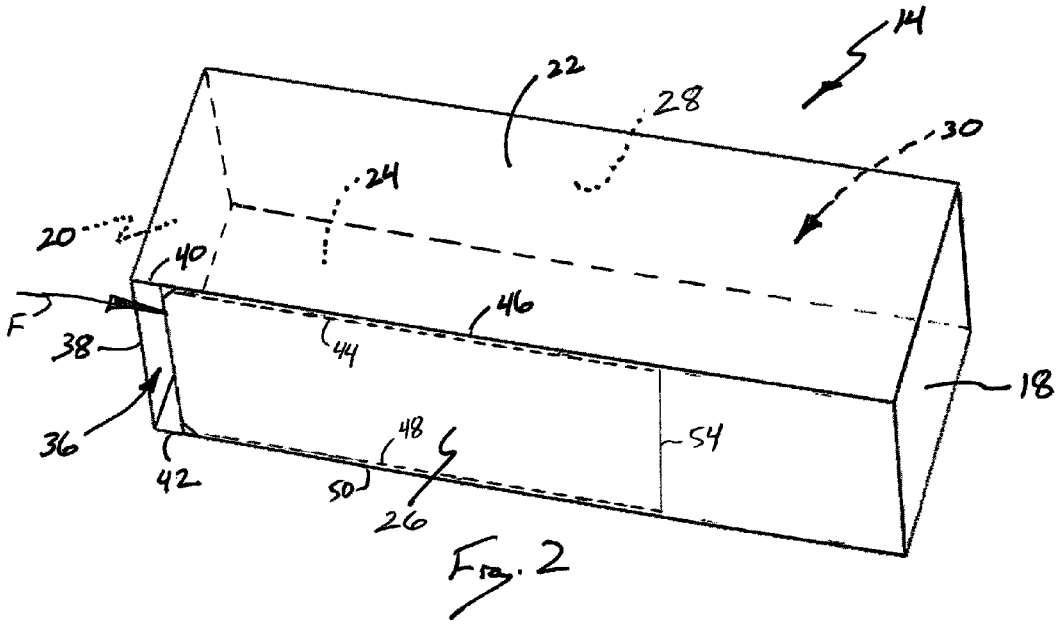
FIG. 2 is a bottom perspective view of the container of the product dispensing system of FIG. 1.
Figure 11:
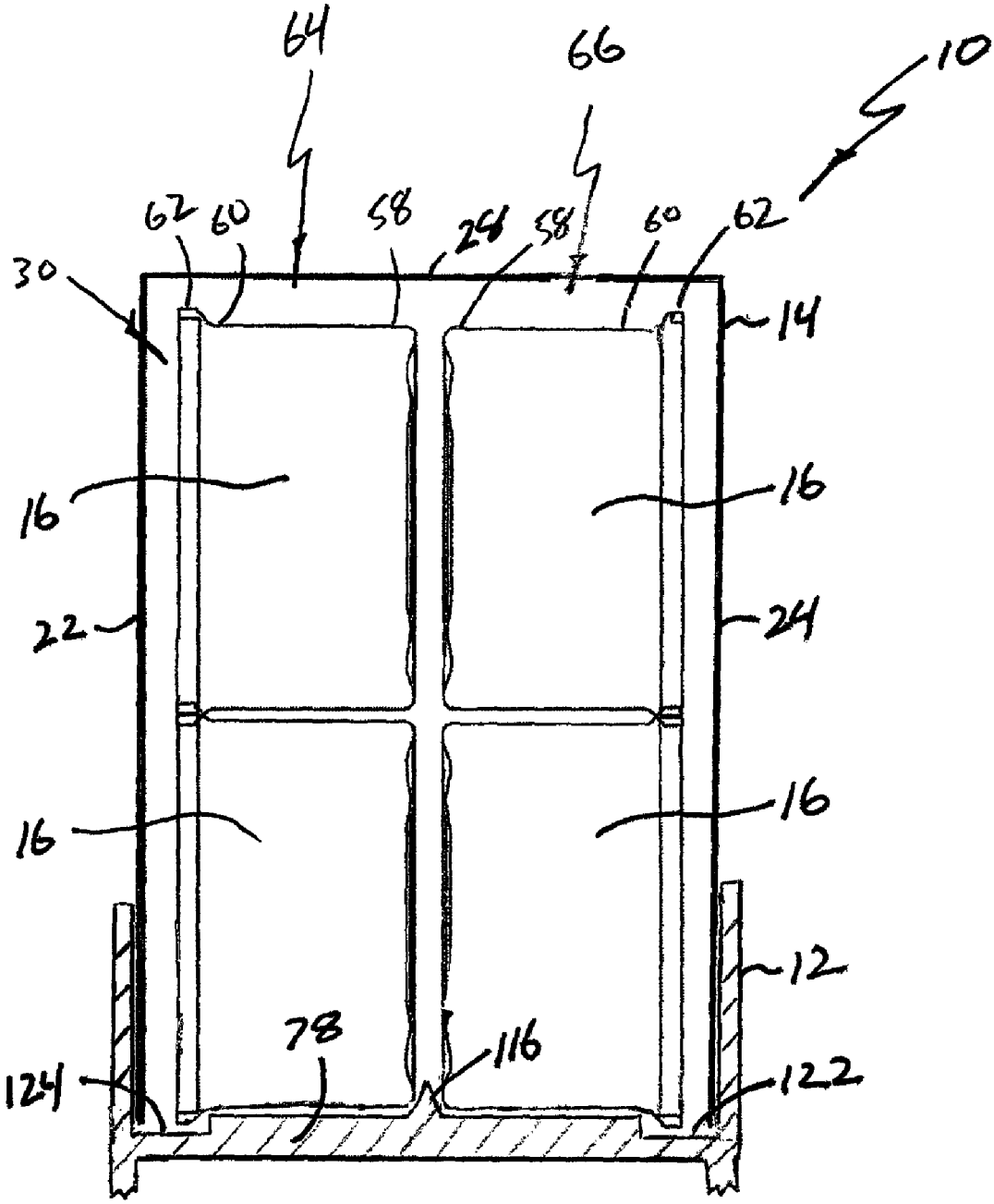
FIG. 11 is a front elevational view of a portion of the product dispensing system of FIG. 1, showing direct contact between the dispenser and products housed in the container.

As shown in FIG. 2, in one construction, the container 14 may be a generally rectilinear container having six walls 18, 20, 22, 24, 26, 28 that define an internal volume 30 for receiving the products 16 (FIGS. 1 and 11). Opposed walls 18 and 20 may define the front and rear walls, respectively, of the container 14. Opposed walls 22 and 24 may define the first (e.g., left) and second (e.g., right) side walls, respectively, of the container 14. Opposed walls 26 and 28 may define the base and upper walls, respectively, of the container 14.

In accordance with well-established techniques, the container 14 may be assembled on a container machine using a container blank that has been pre-cut from a sheet of stock material. As one example, the stock material may be a paperboard-based material, such as C1S paperboard, which may have a coating (e.g., clay) on a first major surface thereof, which may form the outer surface 32 (FIG. 1) of the container 14, and an uncoated second major surface. As another example, the stock material may be C2S paperboard, which may have a coating (e.g., clay) on both major surfaces thereof. Optionally, at least one major surface of the container blank may be marked with various indicia 34 (FIG. 1), such as printed text and/or graphics.

In one implementation, the base wall 26 of the container 14 may define a pre-formed opening 36 into the internal volume 30 of the container 14. For example, the opening 36 may be formed proximate (i.e., at or near) the rear wall 20 of the container 14, such as along the edge 38 between the base wall 26 and the rear wall 20.

In another implementation, the base wall 26 of the container 14 may include a removable feature (not shown) that, when removed from the container 14, reveals the opening 36 into the internal volume 30 of the container 14. For example, the removable feature may be a zipper strip or a peelable label.

The opening 36 may extend generally laterally between the side walls 22, 24 of the container 14. For example, the opening 36 may include a first (e.g., left) end 40 positioned proximate the left side wall 22 of the container 14 and a second (e.g., right) end 42 positioned proximate the right side wall 24 of the container 14.

Those skilled in the art will appreciate that the opening 36 may be positioned at various alternative locations and may have various alternative configurations, provided that the opening 36 is capable of being engaged by the dispenser 12 when the container 14 is being loaded onto the dispenser 12. As a first alternative implementation, the opening 36 may be formed in the rear wall 20 of the container 14. As a second alternative implementation, the opening 36 may be formed in the base wall 26, between the front 18 and rear 20 walls of the container 14. Other implementations are also contemplated.

A first weakening feature 44 may generally longitudinally extend from the opening 36 toward the front wall 18 of the container 14. The first weakening feature 44 may be formed in the base wall 26 proximate the edge 46 between the base wall 26 and the left side wall 22. As one example, the first weakening feature 44 may extend along at least 50 percent of the length of the edge 46. As another example, the first weakening feature 44 may extend along at least 70 percent of the length of the edge 46. As yet another example, the first weakening feature 44 may extend along at least 80 percent of the length of the edge 46.

A second weakening feature 48 may generally longitudinally extend from the opening 36 toward the front wall 18 of the container 14, and may be laterally spaced from the first weakening feature 44. The second weakening feature 48 may be formed in the base wall 26 proximate the edge 50 between the base wall 26 and the right side wall 24. As one example, the second weakening feature 48 may extend along at least 50 percent of the length of the edge 50. As another example, the second weakening feature 48 may extend along at least 70 percent of the length of the edge 50. As yet another example, the second weakening feature 48 may extend along at least 80 percent of the length of the edge 50.

Figure 3:
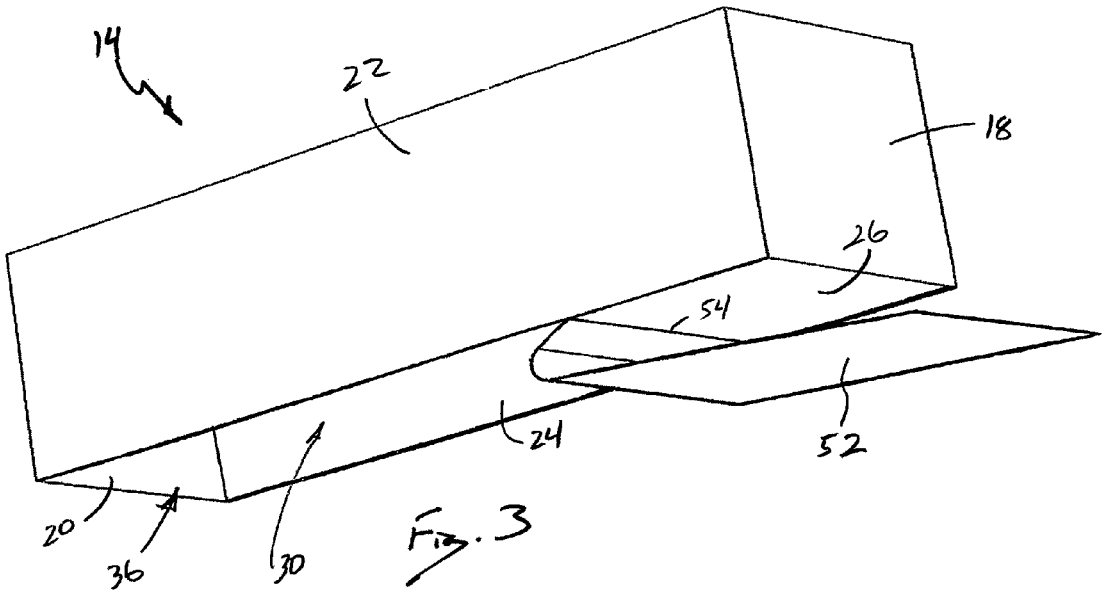
FIG. 3 is a side and bottom perspective view of the container of FIG. 2, shown in a fully opened configuration.

The first and second weakening features 44, 48 may facilitate the separation of a portion of the base wall 26 from the rest of the container 14, as shown in FIG. 3. In a first implementation, the first and second weakening features 44, 48 may be formed as rows of perforations. For example, the first and second weakening features 44, 48 may be formed as rows of standard perforations, as rows of micro perforations or as rows of zipper-like cuts. In a second implementation, the first and second weakening features 44, 48 may be formed by scoring the container 14. In a third implementation, the first and second weakening features 44, 48 may be formed by creasing the container 14. Other techniques useful for forming the first and second weakening features 44, 48 will become apparent to those skilled in the art.

Thus, a force F (FIG. 2) applied to the base wall 26 at the opening 36 may partially separate a portion of the base wall 26 from the container 14 along the first and second weakening features 44, 48 to form an access panel 52, as shown in FIG. 3. As the access panel 52 is separated from the remainder of the container 14 and urged toward the front of the container 14 (i.e., toward the front wall 18), the size of the opening 32 may be significantly increased, thereby allowing the products 16 housed in the container 14 to be dispensed from the container 14.

Optionally, a preformed fold line 54 may laterally extend across the base wall 26 to encourage the access panel 52 to pivot relative to the base wall 26. Without being limited to any particular theory, it is believed that a preformed fold line 54 may reduce or eliminate the possibility that the access panel 52 will randomly fold or bunch-up as the access panel 52 is formed and urged toward the front of the container 14.

Various products 16 having various shapes and configurations may be housed in the container 14 and dispensed by the disclosed product dispensing system 10. Suitable products 16 include cans (e.g., canned soup or pet food), jars (e.g., jarred sauce) or bottles (e.g., bottled soft drinks).

Figure 4:
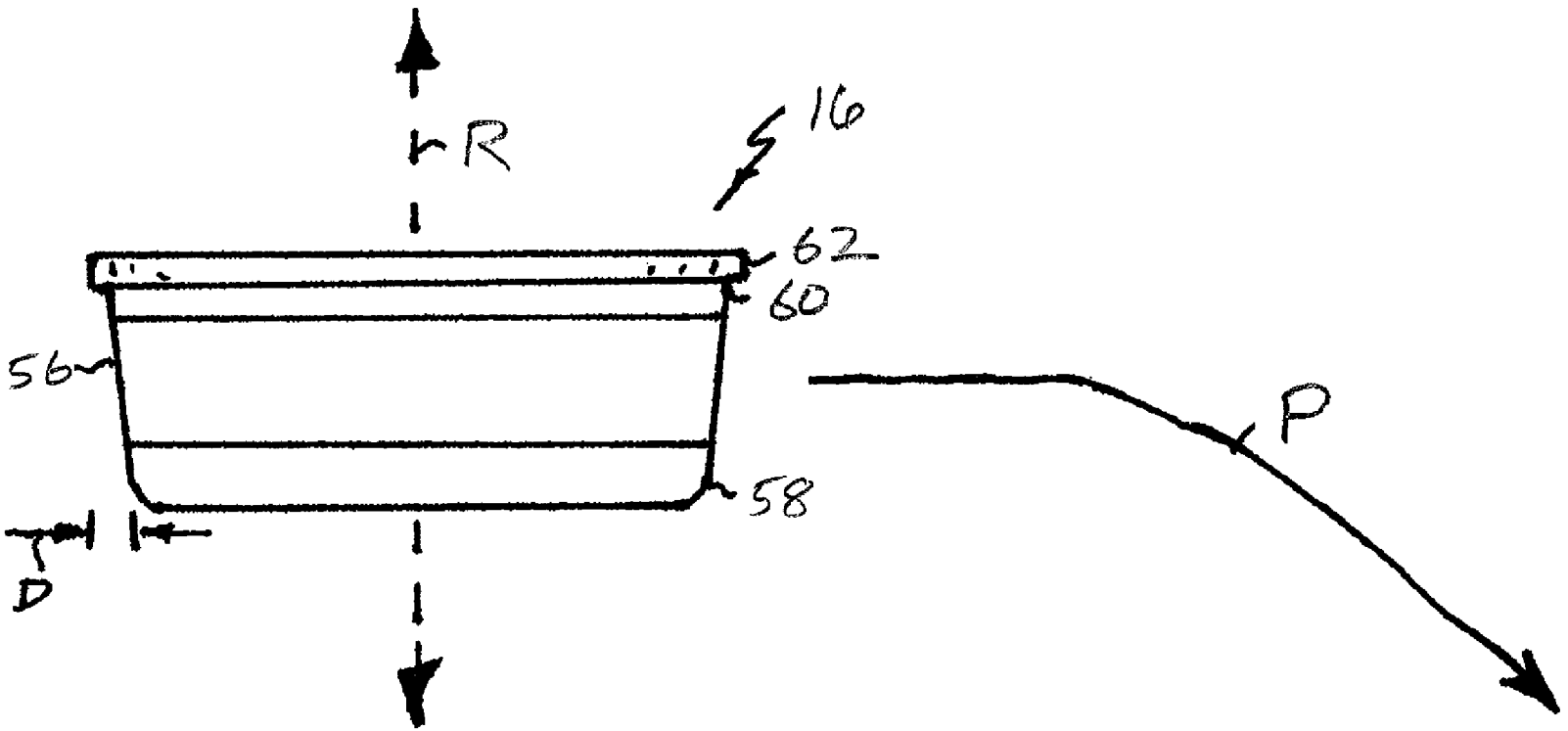
FIG. 4 is a top plan view of a product that may be housed in the container of FIG. 2 and dispensed by the product dispensing system of FIG. 1.

Certain products 16, such as the can 16 shown in FIG. 4, may not be symmetrical about their rolling axis R, resulting in a nonlinear rolling path P. For example, the can 16 shown in FIG. 4 may include a circumferential side wall 56 having a first end 58 and a second end 60, wherein the second end 60 is sealed with a chime 62. Therefore, the second end 60 may extend further outward from the rolling axis R than the first end 58 (i.e., the second end 60 may have a greater radius than the first end 58), resulting in the product 16 rolling in a nonlinear path P. Nonetheless, such products 16 may be suitable for use in the disclosed product dispensing system 10.

As best shown in FIG. 11, the products 16 may be housed in the internal volume 30 of the container 14. In one particular expression, the products 16 may be arranged in the container 14 in two lanes 64, 66, with the first ends 58 of the products 16 in the first lane 64 arranged in facing alignment with the first ends 58 of the product 16 in the second lane 66. Therefore, the second ends 60 (including the chimes 62) of the products 16 in the first lane 64 are in facing alignment with the left side wall 22 and the second ends 60 (including the chimes 62) of the products 16 in the second lane 66 are in facing alignment with the right side wall 24. Each lane 64, 66 of products 16 may include one or more rows of products 16. For example, two stacked rows of products 16 per lane are shown in FIG. 11.

Figure 5:
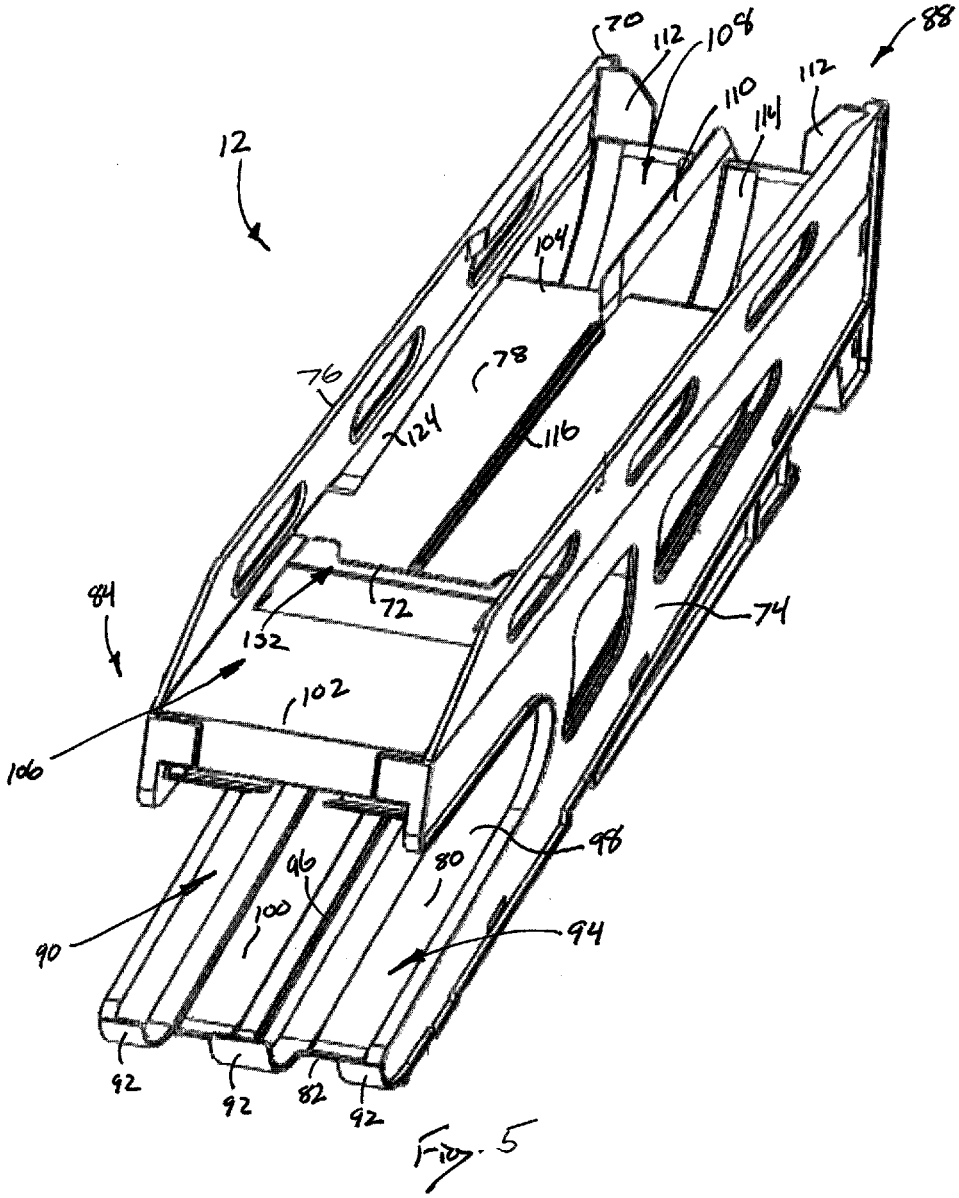
FIG. 5 is a top and front perspective view of the dispenser of the product dispensing system of FIG. 1.
Figure 6:
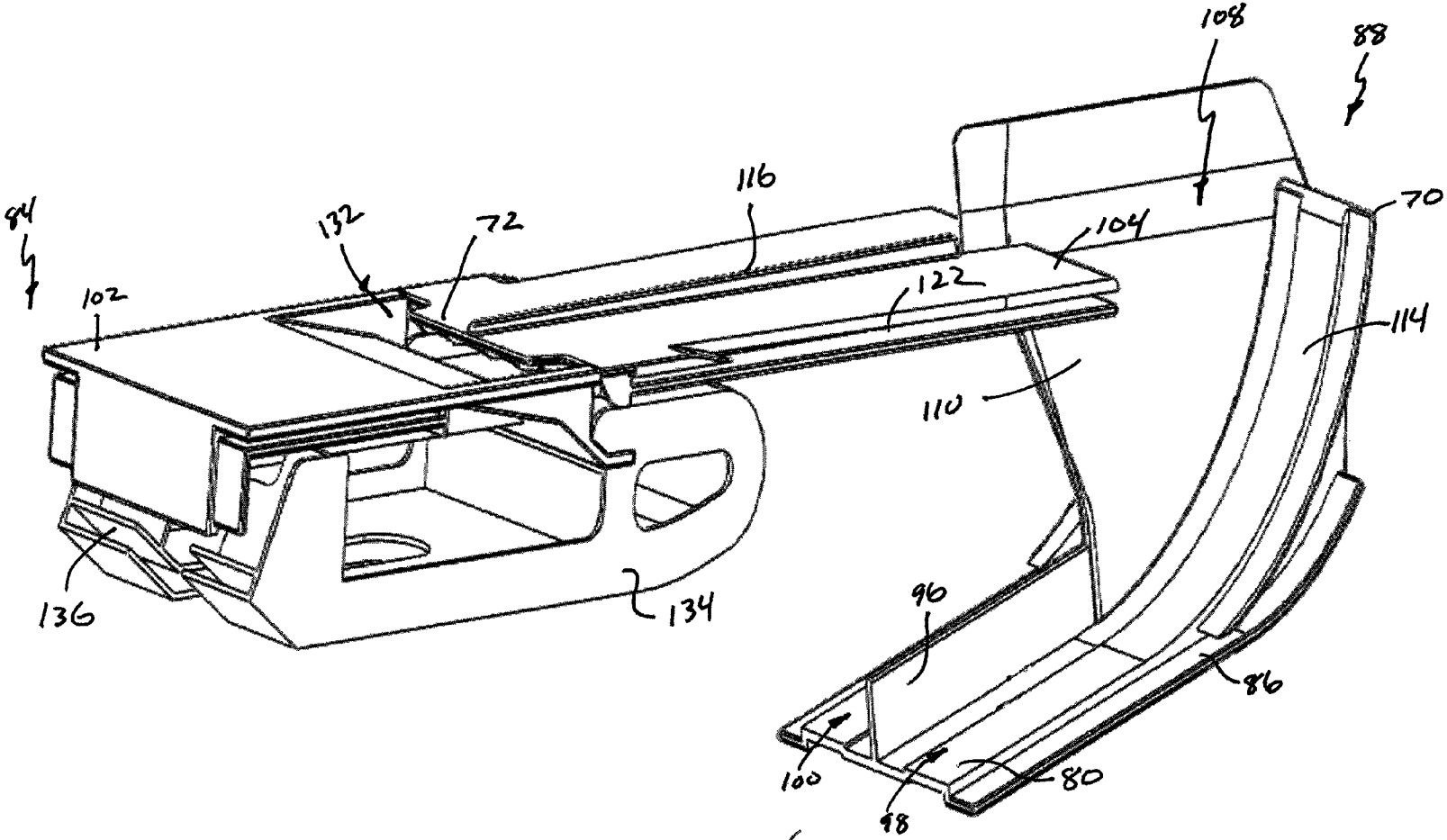
FIG. 6 is a side perspective view of a portion of the dispenser of FIG. 5.

Referring to FIGS. 5 and 6, the dispenser 12 may include a frame 70 and a catch element 72. The frame 70 of the dispenser 12 may support the container 14 in a desired configuration, such as a slightly declined, but generally horizontal configuration, as shown in FIG. 1. As the container 14 is generally horizontally urged along the dispenser 12 to the configuration shown in FIG. 1, the catch element 72 may engage the opening 36 (FIG. 2) in the container 14 to separate the access panel 52 (FIG. 3) from the container 14, as is described in greater detail herein.

Those skilled in the art will appreciate that the dispenser 12 may include additional components and features, such as one or more of the components and features of the dispensers disclosed in U.S. Pat. No. 7,922,437, without departing from the scope of the present disclosure.

The frame 70 may include a first (e.g., right) side wall 74, a second (e.g., left) side wall 76, an upper support deck 78 and a lower support deck 80. The right side wall 74 may be laterally spaced from the left side wall 76, and may be generally parallel with the left side wall 76. The frame 70 may include a first (e.g., front) end 84 and a second (e.g., rear) end 88 longitudinally opposed from the first end 84.

The lower support deck 80 may laterally extend between the right 74 and left 76 side walls, and may include a front end 82 that longitudinally extends toward the front end 84 of the frame 70 and a rear end 86 (FIG. 6) that longitudinally extends toward the rear end 88 of the frame 70. Therefore, the lower support deck 80 and the side walls 74, 76 may define a lower level 90 of the frame 70.

The lower support deck 80 may be inclined from the front end 82 to the rear end 86 (i.e., the rear end 86 may be elevated relative to the front end 82) such that products 16 deposited proximate the rear end 86 of the lower support deck 80 roll down to the front end 82 of the lower support deck 80 under the force of gravity. The extent of the incline of the lower support deck 80 may be dictated by, among other things, the coefficient of friction of the material used to form the frame 70 and the shape of the products 16 to be dispensed by the dispenser 12.

One or more stops 92 may be positioned proximate the front end 82 of the lower support deck 80 to prevent products 16 from rolling beyond the front end 82 of the lower support deck 80. For example, the stops 92 may be connected to (e.g., integral with) the lower support deck 80, and may form an upward curve at the front end 82 of the lower support deck 80. Therefore, the stops 92 may collect products 16 at the front end 82 of the lower support deck 80, thereby defining a product display area 94 at the front end 82 of the lower support deck 80.

Optionally, the frame 70 may include a divider 96 extending from the front end 82 of the lower support deck 80 to the rear end 86 of the lower support deck 80 to divide the lower level 90 into a first product lane 98 and a second product lane 100. The first product lane 98 may be defined by the lower support deck 80, the right side wall 74 and the divider 96, and may extend from proximate the rear end 86 of the lower support deck 80 to proximate the front end 82 of the lower support deck 80. The second product lane 100 may be defined by the lower support deck 80, the left side wall 76 and the divider 96, and may extend from proximate the rear end 86 of the lower support deck 80 to proximate the front end 82 of the lower support deck 80.

At this point, those skilled in the art will appreciate that two product lanes 98, 100 may be advantageous when the dispenser 12 will be used to dispense products 16 arranged in the container 14 in two or more lanes 64, 66 (FIG. 11). However, the frame 70 may be constructed to provide only one product lane or more than two product lanes, without departing from the scope of the present disclosure.

The upper support deck 78 may laterally extend between the right 74 and left 76 side walls, and may include a front end 102 that longitudinally extends toward the front end 84 of the frame 70 and a rear end 104 that longitudinally extends toward, but not to, the rear end 88 of the frame 70. Therefore, the upper support deck 78 and the side walls 74, 76 may define an upper level 106 of the frame 70.

The spacing between the rear end 104 of the upper support deck 78 and the rear end 88 of the frame 70 may define an opening 108, which may function as a chute to allow products 16 to move from the upper level 106 to the lower level 90 of the frame 70.

A partition 110 may longitudinally extend through the opening 108 from the upper level 106 to the lower level 90 of the frame 70. Therefore, products 16 on the right side of the partition 110 may be directed through the opening 108 to the first product lane 98 and products 16 on the left side of the partition 110 may be directed through the opening 108 to the second product lane 100.

The upper support deck 78 may be declined from the front end 102 to the rear end 104 (i.e., the front end 102 may be elevated relative to the rear end 104). Therefore, products 16 supported on the upper support deck 78 may roll under the force of gravity down to the rear end 104 of the upper support deck 78, through the opening 108, to the lower level 90 of the frame 70 and, ultimately, to the product display area 94.

An optional rear wall 112 may be positioned at the rear end 88 of the frame 70 between the right 74 and left 76 side walls. The rear wall 112 may serve as a stop that inhibits rearward horizontal movement of the container 14 (FIG. 1) along the upper support deck 78 beyond the rear wall 112.

A guide 114 may be connected to the rear wall 112 of the frame 70, and may extend through the opening 108 in the frame 70, from the upper level 106 to the lower level 90. The guide 114 may be a ramp-like structure, and may be positioned to receive products 16 exiting the container 14 and passing through the opening 108 in the frame 70, and may guide the products 16 to the rear end 86 of the lower support deck 80.

Figure 7:
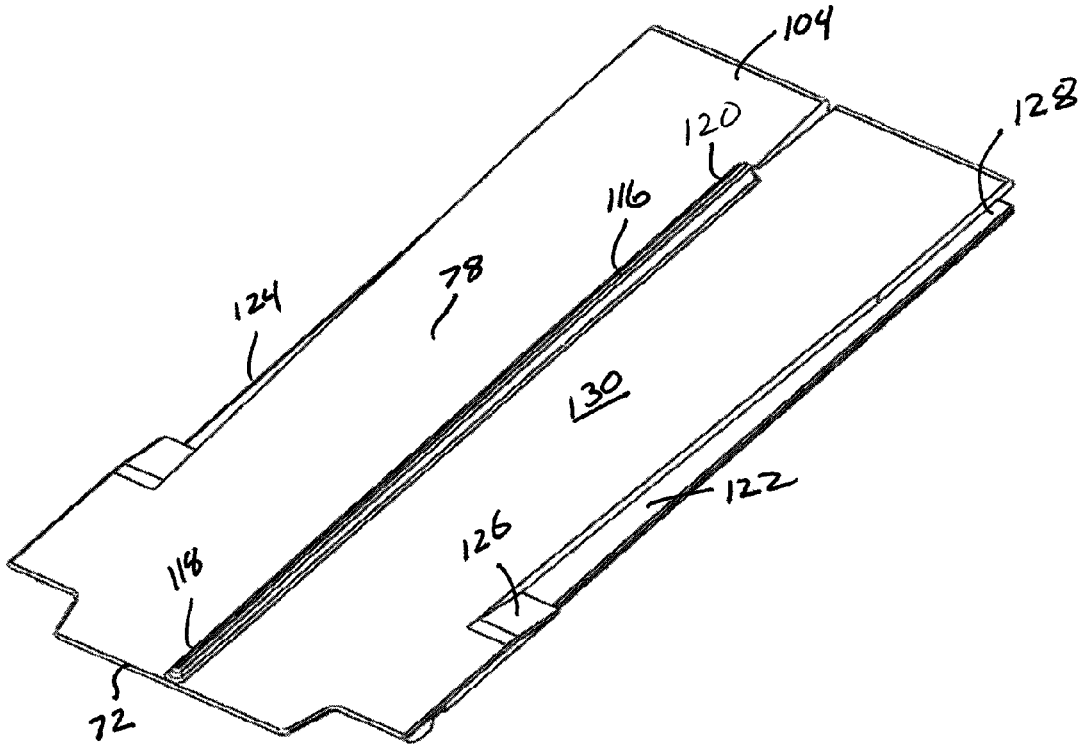
FIG. 7 is a top perspective view of the upper support deck of the dispenser of FIG. 5.

Referring to FIGS. 5-7, an elongated protrusion 116, such as a rib, may longitudinally extend along the upper support deck 78 between the side walls 74, 76 of the frame 70. The protrusion 116 may include a first end 118 positioned proximate the catch element 72 and a second end 120 positioned proximate the rear end 104 of the upper support deck 78.

The protrusion 116 may be connected to the upper support deck 78 and may protrude upward from the plane defined by the upper support deck 78. Those skilled in the art will appreciate that "connected" includes constructions where the protrusion 116 and the upper support deck 78 are integral (i.e., formed as a single monolithic body), as well as constructions where the protrusion 116 is a separated piece that has been attached to the upper support deck 78, such as with mechanical fasteners (e.g., rivets) and/or adhesives (e.g., an epoxy adhesive).

Thus, as shown in FIG. 11, the protrusion 116 may function as a barrier between the lanes 64, 66 of products 16 supported on the upper support deck 78 of the frame 70 of the dispenser 12.

While a single protrusion 116 is shown in the drawings, those skilled in the art will appreciate that two or more spaced, generally parallel protrusions 116 may be used, and that each protrusion 116 may be comprised of multiple segments (i.e., each protrusion 116 need not be a continuous protrusion). Those skilled in the art will appreciate that the number of protrusion employed may depend on the number of lanes 64, 66 of products 16 housed in the container 14.

Still referring to FIGS. 5-7, the upper support deck 78 may define first and second elongated channels 122, 124. The first channel 122 may be recessed in the upper support deck 78, and may longitudinally extend between first 126 and second 128 ends along the upper support deck 78 proximate the right side wall 74. The second channel 124 may be recessed in the upper support deck 78, and may longitudinally extend along the upper support deck 78 proximate the left side wall 76.

Thus, as shown in FIG. 11, the chimes 62 of the products 16 may be received in the channels 122, 124, thereby compensating for the asymmetry of the products 16 and providing for a straighter rolling path.

The catch element 72 may be connected to the upper support deck 78. The catch element 72 may laterally extend between the side walls 74, 76 of the frame 70, and may longitudinally protrude toward the front end 84 of the frame 70.

The catch element 72 may be positioned proximate the front end 102 of the upper support deck 78. As one example, the distance between the front end 102 of the upper support deck 78 and the catch element 72 may be at most 50 percent of the distance between the front end 102 of the upper support deck 78 and the rear end 104 of the upper support deck 78. As another example, the distance between the front end 102 of the upper support deck 78 and the catch element 72 may be at most 40 percent of the distance between the front end 102 of the upper support deck 78 and the rear end 104 of the upper support deck 78. As yet another example, the distance between the front end 102 of the upper support deck 78 and the catch element 72 may be at most 30 percent of the distance between the front end 102 of the upper support deck 78 and the rear end 104 of the upper support deck 78.

In an effort to minimize interference between the catch element 72 and the container 14 during loading, the catch element 72 may be substantially co-planar with the upper surface 130 (FIG. 7) of the upper support deck 78. However, those skilled in the art will appreciate that slight displacement and/or a slight angle of the catch element 72 relative to the upper surface 130 of the upper support deck 78 may encourage engagement of the opening 36 in the container 14 by the catch element 72.

While the catch element 72 is shown and described as a generally flat, laterally elongated protrusion, those skilled in the art will appreciate that various alternative structures may be used as the disclosed catch element 72 without departing from the scope of the present disclosure. For example, suitable catch elements 72 may include various hooks, protrusions, flanges, detents and the like sufficient to engage the opening 36 in the container 14 and separate the access panel 52 from the base wall 26 of the container 14.

Referring back to FIGS. 5 and 6, the upper support deck 78 may define an opening 132 below the catch element 72. The opening 132 may extend from proximate the catch element 72 toward the front end 102 of the upper support deck 78. The opening 132 may laterally extend between the side walls 74, 76 of the frame 70, and may have a lateral width sufficient to allow the access panel 52 (FIG. 3) to pass therethrough.

Figure 8:
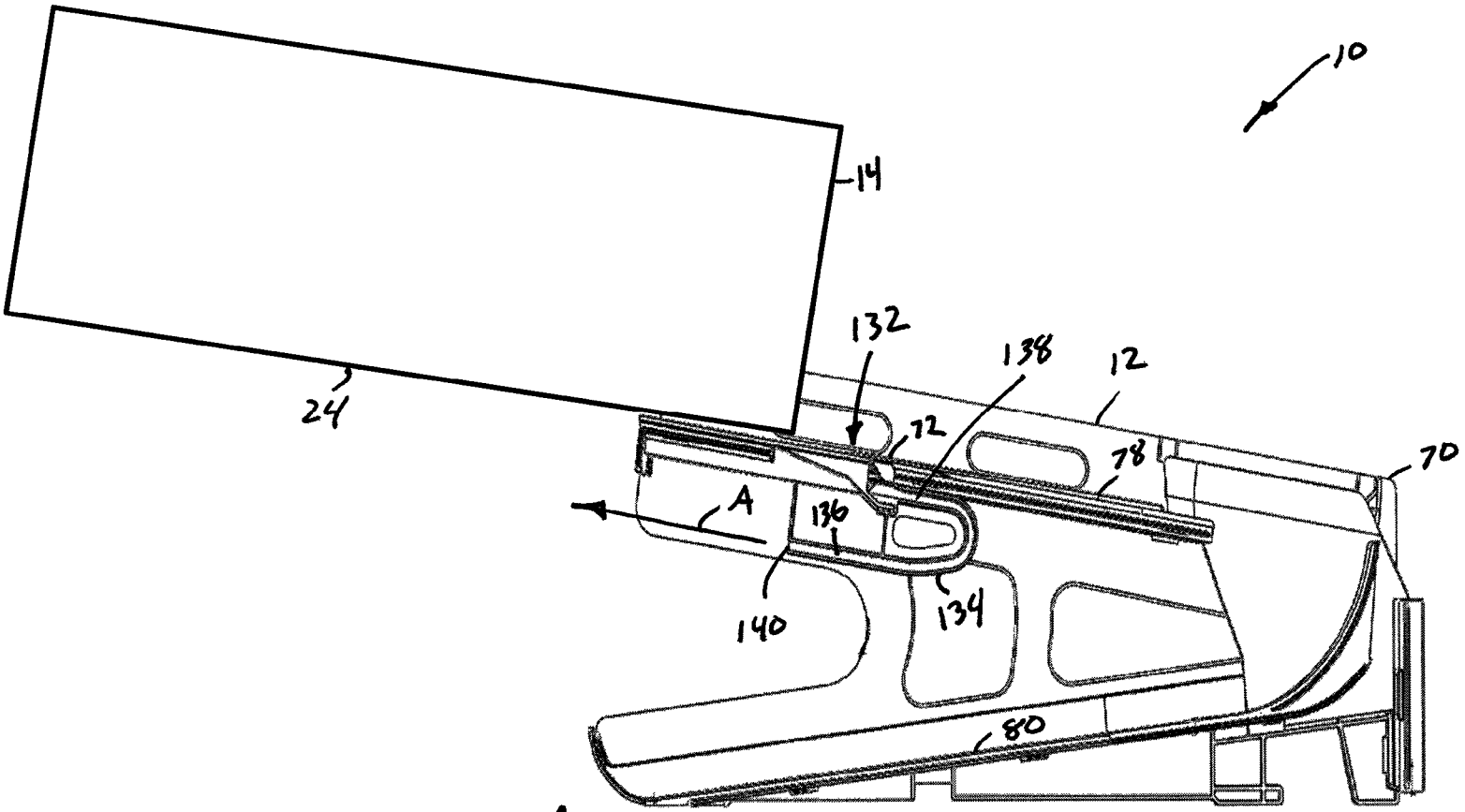
FIG. 8 is a side elevational view, in section, of the dispenser of FIG. 5, shown with the container in a first, partially loaded configuration.

As best shown in FIGS. 6 and 8, a panel guide assembly 134 may be connected to the upper support deck 78 below the opening 132. The panel guide assembly 134 may define a U-shaped channel 136 having a first end 138 and a second end 140. The first end 138 of the channel 136 may be coupled to the opening 132 in the upper support deck 78. The second end 140 of the channel 136 may be directed toward the front end 84 of the frame 70, as shown by arrow A (FIG. 8).

Thus, the catch element 72 may engage the opening 36 (FIG. 2) in the container 14 and may separate the access panel 52 (FIG. 3) from the container 14 as the container 14 is moved horizontally along the upper support deck 78 toward the rear end 88 of the frame 70. The shape and position of the catch element 72 may be configured such that a portion of the catch element 72 extends through the opening 36 (FIG. 2) in the container 14. Therefore, as the container 14 moves relative to the catch element 72, the catch element 72 may urge the base wall 26 downward through the opening 132 and into the panel guide assembly 134, thereby causing separating of the access panel 52 from the container 14 along the first and second weakening features 44, 48 and, ultimately, the formation of a larger opening 36 sufficient to release the products 16 from the container 14.

Figure 9:
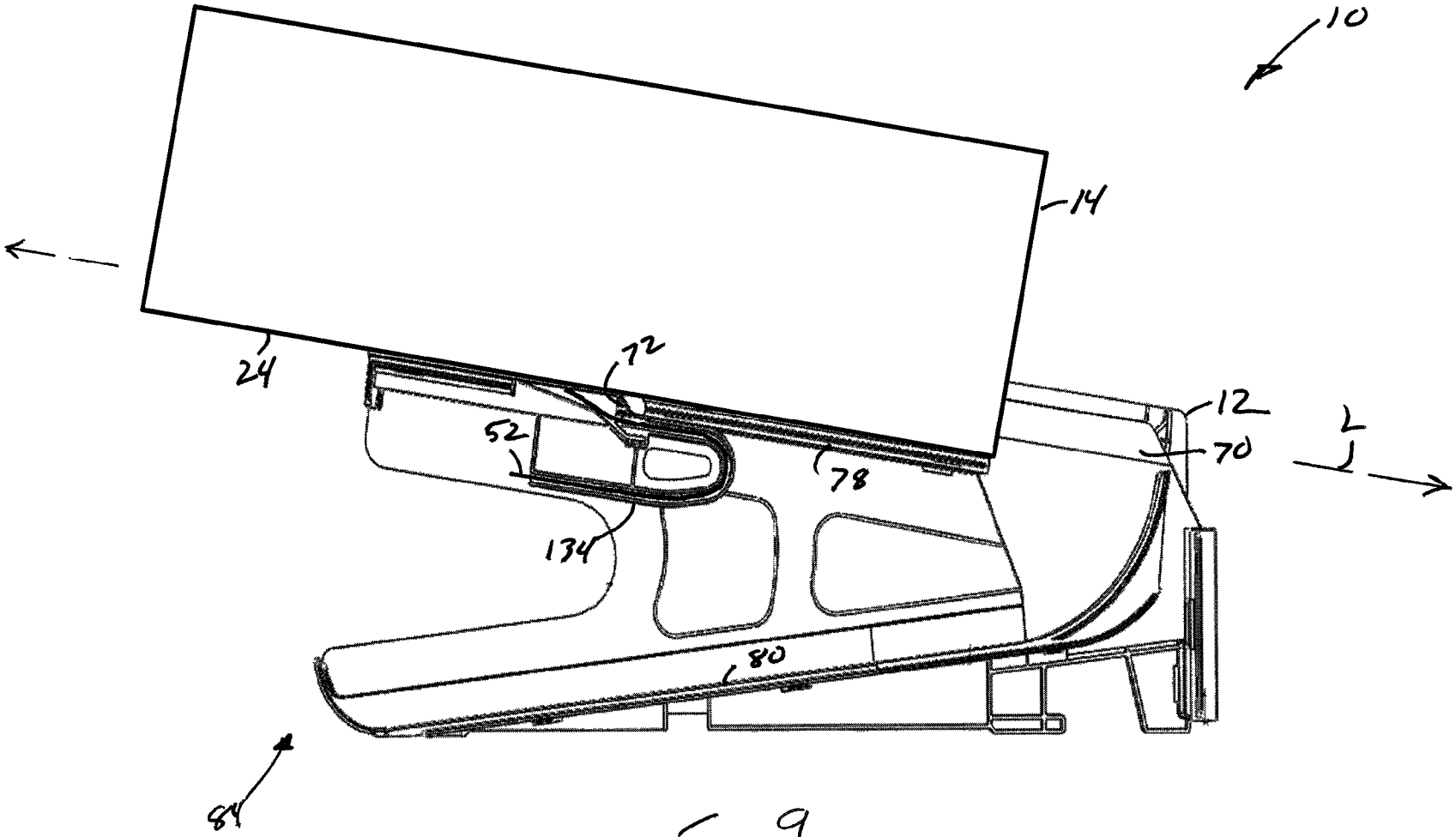
FIG. 9 is a side elevational view of the dispenser of FIG. 8, shown with the container in a second, partially loaded configuration.
Figure 10:
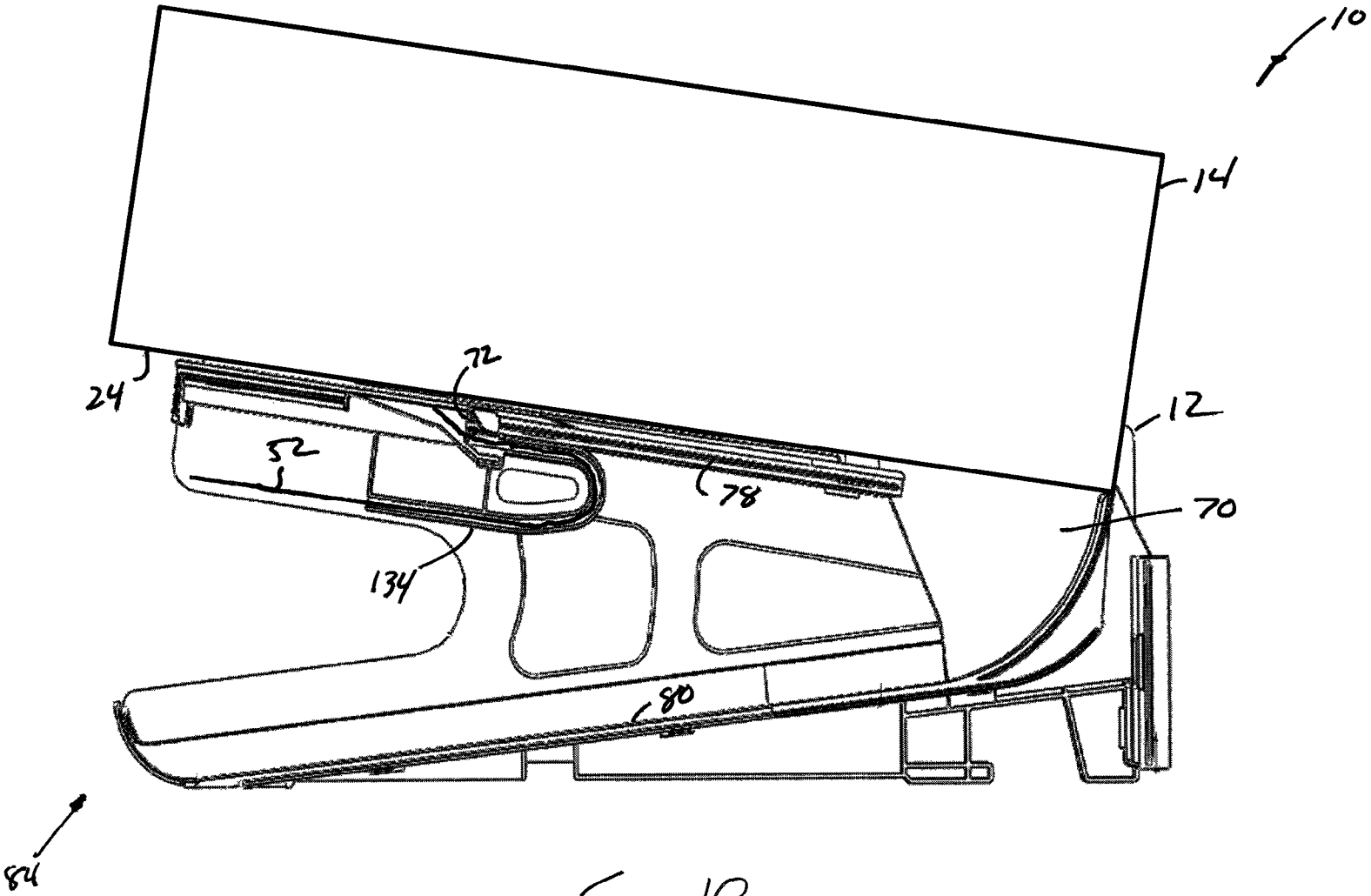
FIG. 10 is a side perspective view of the dispenser of FIG. 9, shown with the container in a fully loaded configuration.

FIGS. 8-10 illustrate the loading of a container 14 onto the dispenser 12. Specifically, FIGS. 8-10 sequentially illustrate a container 14 being positioned on the front end 102 the upper support deck 78 (FIG. 8), being urged generally horizontally along the upper support deck 78 (i.e., along the longitudinal axis L of the upper support deck 78) toward the rear end 88 of the dispenser frame 70 (FIG. 9), and ultimately reaching the fully loaded configuration (FIG. 10).

Opening of the container 14 is facilitated by the engagement between the catch element 72 of the dispenser 12 and the opening 36 in the container 14 as the container 14 moves along the dispenser 12. Specifically, as the opening 36 (FIG. 2) in the container 14 approximates the catch element 72 of the dispenser 12, the catch element 72 may extend through the opening 36 and may begin to separate the access panel 52 from the base wall 24 of the container 14. As the access panel 52 is separated from the base wall 24 of the container 14, the catch element 72 may guide the separated access panel 52 downward through the opening 132 in the upper support deck 68 and, ultimately, into the panel guide assembly 134, as shown in FIG. 9.

As shown to FIG. 10, once the container 14 has been fully loaded onto the dispenser 12, the panel guide assembly 134 will have redirected the separated access panel 52 toward the front end 84 of the dispenser frame 70. With the access panel 52 separated from the container 14 and redirected by the panel guide assembly 134, the products 16 housed in the container 14 may roll along the upper support deck 78, pass through the opening 108 in the frame 70 to the lower level 90 of the frame 70, and roll along the lower support deck 80 to the product display area 94.

Upon separation of the access panel 52 from the container 14, at least some of the products 16 housed in the container 14 may be in direct contact with the upper support deck 78, as shown in FIG. 11. Therefore, the protrusion 116 and the channels 122, 124 may guide the products 16 along the upper support deck 78 as they move to the product display area 94 (FIG. 5).

Accordingly, by positioning the catch element 72 proximate the front end 102 of the upper support deck 78, a larger portion of the base wall 26 may be removed during separation of the access panel 52 and, hence, a larger opening 36 may be formed. Removing a larger portion of the base wall 26 may increase the amount of direct contact between the products 16 housed in the container 14 and the upper support deck 78 of the dispenser frame 70. Without being limited to any particular theory, it is believed that increasing product-to-upper-support-deck contact may provide greater control over the movement of products 16 within the product dispensing system 10 because the movement of products 16 that are in direct contact with the dispenser frame 70 is more predictable (e.g., less prone to jamming) than the movement of products 16 along the container 14. The use of the protrusion 116 and channels 122, 124 on the upper support deck 78 may further improve product movement in the disclosed product dispensing system 10.

Although various aspects of the disclosed product dispensing system with increased product-to-dispenser contact have been shown and described, modifications may occur to those skilled in the art upon reading the specification. For example, while a front-loading dispenser (i.e., a dispenser wherein the container is loaded from the front toward the rear) is shown and described), a rear-loading dispenser (i.e., a dispenser wherein the container is loaded from the rear toward the front) is also contemplated. The present application includes such modifications and is limited only by the scope of the claims.

What is claimed is:

1. A product dispensing system comprising:

a container defining an internal volume and an opening into said internal volume, said container comprising a weakening feature, wherein said opening and said weakening feature define an access panel; and a dispenser comprising:

a frame having longitudinally opposed first and second ends, said frame comprising a support deck and a product display area, said support deck extending at least partially between said first end and said second end, said product display area being positioned below said support deck; and a catch element connected to said frame proximate said first end, said catch element protruding away from said second end such that said catch element engages said opening in said container and at least partially separates said access panel from said container as said container longitudinally moves along said support deck from said first end toward said second end; and an opening in said support deck, and wherein said catch element is positioned at least partially over said opening in said support deck; and wherein said access panel extends through said opening in said support deck as said container longitudinally moves along said support deck from said first end toward said second end; and a guide panel assembly defining a channel for receiving said access panel, said channel having a first end and a second end, and wherein said first end of said channel is coupled with said opening in said support deck and said second end of said channel opens toward said first end of said frame.

2. The product dispensing system of claim 1 wherein said weakening feature is a first weakening feature, and wherein said container further comprises a second weakening feature laterally spaced from said first weakening feature.

3. The product dispensing system of claim 1 wherein said product display area is positioned proximate said first end of said frame.

4. The product dispensing system of claim 1 further comprising a plurality of products in said internal volume.

5. The product dispensing system of claim 4 wherein at least one product of said plurality of products is in direct contact with said support deck after said access panel has been separated from said container.

6. The product dispensing system of claim 4 wherein said support deck comprises at least one protrusion longitudinally extending between said first end and said second end of said frame.

7. The product dispensing system of claim 6 wherein said protrusion separates said plurality of products into at least a first lane of products and a second lane of products.

8. The product dispensing system of claim 4 wherein said support deck defines at least one channel longitudinally extending between said first end and said second end.

9. The product dispensing system of claim 8 wherein at least a portion of at least one product of said plurality of products is received in said channel.

10. The product dispensing system of claim 1 wherein said channel is generally U-shaped.

11. A product dispensing system comprising:

a container defining an internal volume and an opening into said internal volume, said container comprising first and second weakening features, wherein said opening and said first and second weakening features define an access panel;

a plurality of products positioned in said internal volume; and a dispenser comprising:

a frame having longitudinally opposed front and rear ends, said frame comprising a support deck and a product display area, said support deck extending at least partially between said front end and said rear end and defining an opening therein, said product display area being positioned below said support deck proximate said front end; and a catch element protruding from said support deck away from said rear end such that said catch element engages said opening in said container, at least partially separates said access panel from said container, and directs said separated access panel through said opening in said support deck as said container longitudinally moves along said support deck from said front end toward said rear end, thereby allowing at least one product of said plurality of products to move along said support deck to said product display area; and a guide panel assembly defining a channel for receiving said access panel, said channel having a first end and a second end, and wherein said first end of said channel is coupled with said opening in said support deck and said second end of said channel opens toward said first end of said frame.

12. The product dispensing system of claim 11 wherein said support deck comprises at least one protrusion longitudinally extending between said front end and said rear end, and wherein said protrusion separates said plurality of products into at least a first lane of products and a second lane of products.

13. The product dispensing system of claim 11 wherein said support deck defines at least one channel longitudinally extending between said front end and said rear end, and wherein at least a portion of at least one product of said plurality of products is received in said channel.

14. A method for dispensing products comprising the steps of:

providing a container housing a plurality of products, said container defining an opening and an access panel; and providing a dispenser comprising:

a frame having longitudinally opposed first and second ends, said frame comprising a support deck and a product display area, said support deck extending at least partially between said first end and said second end, said product display area being positioned below said support deck; and a catch element connected to said frame proximate said first end, said catch element protruding away from said second end;

an opening in said support deck, and wherein said catch element is positioned at least partially over said opening in said support deck; and a guide panel assembly defining a channel for receiving said access panel, said channel having a first end and a second end, and wherein said first end of said channel is coupled with said opening in said support deck and said second end of said channel opens toward said first end of said frame;

urging said container longitudinally along said support deck from said first end toward said second end of said frame such that said catch element engages said opening in said container and at least partially separates said access panel from said container, said access panel extending through said opening, and along said channel, thereby allowing at least one product of said plurality of products to move along said support deck and down to said product display area.

* * * * *